United States Patent [19]

Monreal

[11] Patent Number: 4,598,927

[45] Date of Patent: Jul. 8, 1986

[54] LONG KNEE-FOOT BOOT FOR SKIING/SLEDDING

[76] Inventor: F. Javier Monreal, 4242 Barker Hill Rd., Jamesville, N.Y. 13078

[21] Appl. No.: 719,525

[22] Filed: Apr. 3, 1985

Related U.S. Application Data

[63] Continuation-in-part of Ser. No. 594,367, Mar. 28, 1984, abandoned.

[51] Int. Cl.[4] ..... A63C 5/00

[52] U.S. Cl. ..... 280/611; 280/618

[58] Field of Search ..... 280/607, 611, 617, 618, 280/12 B, 809

[56] References Cited

U.S. PATENT DOCUMENTS

| | | | |
|---|---|---|---|
| 1,668,623 | 5/1928 | Avril | 280/87.02 R |
| 2,318,059 | 5/1943 | Cooper | 280/32.6 X |
| 2,484,494 | 10/1949 | Ferguson | 280/32.6 X |
| 3,689,092 | 9/1972 | Lake | 280/809 X |
| 4,098,522 | 7/1978 | Beyl | 280/618 |
| 4,353,573 | 10/1982 | Morgan | 280/12 R X |

FOREIGN PATENT DOCUMENTS

| | | | |
|---|---|---|---|
| 174845 | 10/1952 | Austria | 280/607 |

*Primary Examiner*—John J. Love
*Assistant Examiner*—Michael Mar

[57] ABSTRACT

A paired sporting equipment (one for each leg) for skiing/sledding in the kneeling position by providing an assembly of a long and firm engulfing shell for the whole lower leg and lower ⅓ of the thigh and a firmly secured rectangular flat board placed under the shell. The device can be used strapless when intended as a recreational toy in small slippery slopes. Straps are provided when the device is used for high speed descend that requires firm control and torque. The flat board of the device can be specifically shaped in its two opposite distal ends so the whole device can be locked to a standard ski by ordinary bindings.

3 Claims, 3 Drawing Figures

LONG KNEE-FOOT BOOT FOR SKIING/SLEDDING

BACKGROUND INFORMATION

This patent application is a continuation-in-part of the earlier application, now abandoned, Ser. No. 06/594,367, filed 3/28/84.

Besides ordinary "standing" skis, several devices have been sought, some patented, for the purpose of sliding/skiing in the kneeling position. Prior art work in this area includes:

R. C. Avril's "Coaster", U.S. Pat. No. 1,668,623

J. J. A. Beyl's "Safety Ski Binding", U.S. Pat. No. 4,098,522

F. T. Cooper's "Kneeling Dolly", U.S. Pat. No. 2,318,059

J. Corriero's "Protective Structures for Joints" U.S. Pat. No. 4,333,181

R. O. Ferguson's "Knee Pad " U.S. Pat. No. 2,484,494

R. Klima's "Kneeling Ski" Austrian Pat. No. 174,845

G. F. Lake "Snow and Water Skimming Device" U.S. Pat. No. 3,689,092

D. F. Morgan's "Knee Engaging Ski", U.S. Pat. No. 4,353,573

Of these patents, only Ferguson's Knee pad and Lake's Snow and Water Skimming device consist of a long concave shell that goes, as in this invention, from knee to foot. Both of these, however, simply offer a rest for the kneeling knee without providing any lateral stabilization of the knee joint itself, with all the torque resting on the securing straps and no torque provided at the thigh level. Corriero's Protective Structures for joints, and Klima's Kneeling Ski do provide a lateral hold and protection of the knee joint, but neither consist of along knee-foot stabilizing and comfortable sheel and neither of them reach into the mid thigh with special thigh wings for optimal torque and protection.

In contrast to the existing art work, this invention offers a "fitted basket" shell or boot for the whole lower leg with substantial extensions into the thigh area medially and laterally, so the whole device quickly responds to the slightest body/thigh tilts in turns without straining the knee joint and without relying, for the turns and torque, on just over-the-calf straps. Additionally, the whole length of this knee-foot boot has a a specially shaped sole so its two end can be secured into ordinary skis with ordinary bindings.

BRIEF DESCRIPTION OF THE INVENTION

This is a paired sporting device conceived for the purpose of sliding downward in slippery surfaces such as snow, ice or grass in the kneeling position. Each member of the pair consists of a lower leg contoured shell that embraces, in the kneeling position, the weight-bearing area of the knee, shin and dorsum of foot and the sides of these anatomical parts, medially and laterally, being open, for entry and release on the top through its entire length; additionally, the sides of the shell by the knee extend upward medially and laterally respectively, to embrace and hold the sides of the thigh in at least its lower one third.

DETAILED DESCRIPTION OF THE INVENTION

This invention consists of a light weight, firm and tear-resistent shell of a sheet of plastic orthotically contoured to the shaped of the lower leg in the kneeling position. It is a paired device, thus requiring one shell for each leg. This shell embraces, in the kneeling position, and all in a continuous and uninterrupted fashion, the weight-bearing area of the knee, shin and dorsum of the foot, the sides of the knee and calf and ankle medially and laterally and the sides of the lower one third of the thigh. This shell is open, for entry and release, and to allow some flexion/extension of the knee, in front of the thigh from the area just above the patella bone, and is also open through its entire top from front to rear ends.

Figure 1:
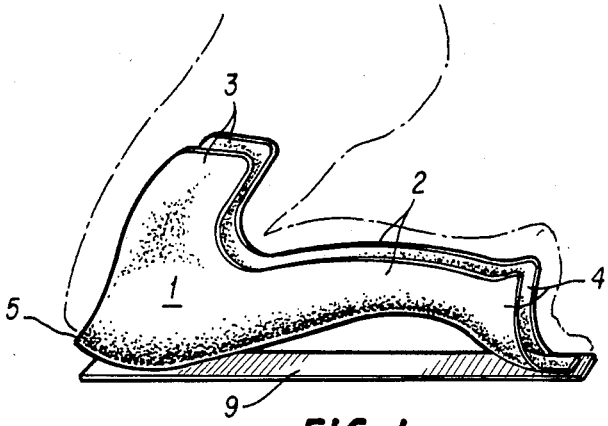
FIG. 1 is a perspective left lateral view of the instant invention. The sliding sole or base is here depicted in rectangular shape without a particular thickness or contour. The user's leg is marked by a dashed line.
Figure 2:
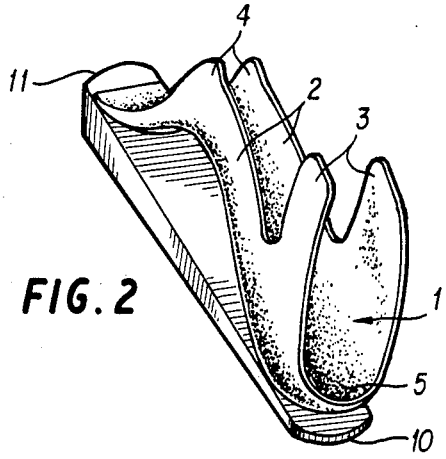
FIG. 2 is a perspective right lateral view of the instant invention seen from its top and front. The sole of base, of rectangular shape, has specifically rounded and thickened opposite ends to fit into ordinary ski bindings.

The contoured sheet of plastic (such as polyethylene or polypropylene) is cast by an injection process or by heat/vacuum molding. The free edges are smooth and rounded avoiding sharp corners. The main weight-bearing area under the user's knee is identified in FIG. 1 by the numeral 1. The long shaft that wraps around the lower leg in a semicircle (leaving the top open for entry) is identified in FIG. 1 by the numeral 2. The lateral parts of the shell that hold the knee joint extend upward to hold at least the lower one third of the sides of the thigh, being these extensions or thigh wings identified by the numerals 3 and 3 medially and laterally. The user's foot/ankle section is held in position by the section of the shell identified by the numeral 4, section that leaves open the user's shoe sole, heel and the area of the heel cord. The weight-bearing area supporting the knee and identified by numeral 1 contours user's patella bone area and ends abruptly just in front of it at lip (numeral 5) above which the user's thigh is left exposed to allow the use of device with varying degrees of knee flexion-/extension. The thigh extension 3 & 3 are provided with some adducting or approximating tension so they embrace the user's thigh without the need of holding straps to stay in place.

Figure 3:
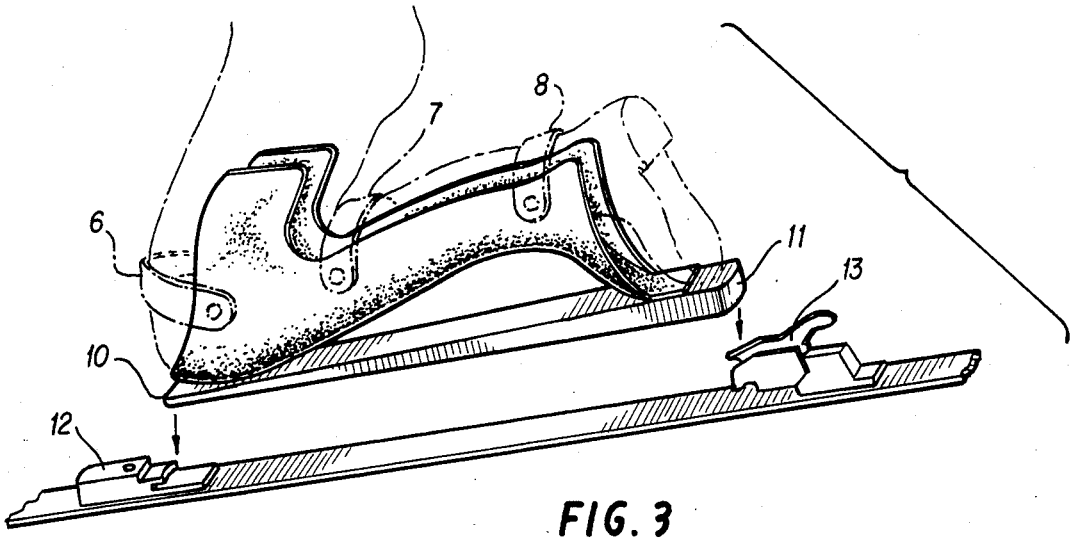
FIG. 3 is a perspective left lateral view of the instant invention, with holding straps, positioned directly above an ordinary snow ski and bindings.

Though the device presents a good hold and torque, as stated above, without the need of holdng straps, specially when used by children in small slopes, straps are provided, however, as shown in FIG. 3 and marked, respectively, by the numerals 6, 7 and 8. Strap 6, of elastic nature, bridges over the anterior part of the user's thigh and while it adds ebracing and holding tension to the thigh wings medially and laterially, its also has some give to permit the user to partially extend the knee. Straps 7 and 8 simply bridge over the user's calf and they provide exclusively a holding action, thus not needing to be elastic. All the three straps are fastened by re-positionable snaps, hooks, buckles or Velcro ®. Due to the contoured shape of the whole shell or long knee-foot boot, the user's leg stays in place nicely without a tendency to forward or backward slide off the device and thus no holding strap around the bottom of the foot is needed. The use of the three described straps is particularly recommended when the device is intended for high descend either as an ice sled in Ad Hoc chutes or when used with bindings and ordinary skis in snow.

The long Knee-Foot Boot described to this point is firmly attached to a supporting sole, being the point of attachment at the knee supporting area and at the foot supporting area as shown in the figures. The support sole, of long, rectangular shape, may or may not have particularly thick and shaped ends if it is just going to be permanently secured (i.e. screwed, etc,) to any sort of sliding board such as a snow ski or even a grass ski. This simple type of support sole is marked in FIG. 1 by the numeral 9.

If this long knee-foot boot is to be used with an ordinary snow ski and using ordinary or standard ski bindings as in FIG. 3, then the two opposite distal ends of the supporting sole need to be specifically thickened and rounded to fit in such bindings as shown in FIGS, 2 and 3 by the numerals 10 and 11. The specific configuration drawn and marked by those numerals 10 and 11 conforms to the standard shape and thickness of ordinary snow ski boots that have the front end relatively flat and wide to fit in the front ski binding (numeral 12), and the rear end relatively thick and narrow to fit in the ordinary rear ski binding (numeral 13). The front, flatter binding is generally the "positioning" binding, for the tip of the boot, and the rear, taller, binding is generally the "locking" binding for the heel. For the type of long knee-foot boot proposed here, unless one is going to permanently secure the long knee-foot to the ski with screws, it is also desirable that one of the bindings at one end be a "positioning" binding and that the other, at the opposite end, be a "locking" binding; nevertheless, because of the anatomy of the lower leg, it may be just as well that the user places the "locking" or taller binding in the front (opposite to what the drawing of FIG. 3 shows), or that both bindings, in the front and in the back, use the "locking" type of binding. Thus it is not a mandatory item of this invention that only the rear or only the front ends of the supporting sole of the long knee-foot be shaped to be held by a standard "locking" or rear ski binding.

I claim:

1. A ski boot for receiving and supporting the knee, lower leg, and foot of a skier while in a kneeling position, comprising:

an open, contoured shell formed from a continuous sheet of lightweight, semirigid material, said shell extending from the knee to the foot of the skier and having a front portion for supporting the skier's knee, a middle portion for supporting the skier's lower leg, and a rear portion for supporting the skier's foot, said front portion having side portions extending upwardly from one third to one half the height of the skier's thigh, said side portions being biased inwardly for engaging the sides of the skier's thigh, said front portion further having an open portion located between the front edges of said side portions through which the front of the skiers's thigh extends, said middle portion having sides extending upwardly for providing lateral support for the skier's lower leg, said rear portion extending downwardly the entire length of the skier's foot and having a horizontally extending portion for supporting the toe portion of the skier's foot, and a rectangular support base extending substantially the entire length of the contoured shell, the bottom surfaces of said front portion and said horizontally extending portion beng permanently secured to the top surface of said support base, wherein said support base is adapted to be secured to the top surface of a ski.

2. A ski boot as defined in claim 1, further including a first adjustable elastic strap extending across the front of the skier's thigh between said upwardly extending side portions, a second adjustable elastic strap extending across the upper part of the skier's lower leg between the sides of said middle portion, and a third adjustable elastic strap extending across the ankle of the skier between the sides of said middle portion.

3. A skil boot as defined in claim 1 wherein said rectangular support has distal ends which are adapted to be engaged by ski bindings for removably securing the support base to the ski.

* * * * *